US012778293B2

(12) United States Patent
Chen et al.

(10) Patent No.: US 12,778,293 B2
(45) Date of Patent: Nov. 3, 2026

(54) SLIDE RAIL MECHANISM

(71) Applicants: King Slide Works Co., Ltd., Kaohsiung City (TW); King Slide Technology Co., Ltd., Kaohsiung City (TW)

(72) Inventors: Ken-Ching Chen, Kaohsiung City (TW); Shun-Ho Yang, Kaohsiung City (TW); Wei-Chen Chang, Kaohsiung City (TW); Chun-Chiang Wang, Kaohsiung City (TW)

(73) Assignees: King Slide Works Co., Ltd., Kaohsiung City (TW); King Slide Technology Co., Ltd., Kaohsiung City (TW)

( * ) Notice: Subject to any disclaimer, the term of this patent is extended or adjusted under 35 U.S.C. 154(b) by 197 days.

(21) Appl. No.: 18/819,664

(22) Filed: Aug. 29, 2024

(65) Prior Publication Data

US 2025/0290545 A1 Sep. 18, 2025

(30) Foreign Application Priority Data

Mar. 12, 2024 (TW) ..... 113109357

(51) Int. Cl.
*A47B 88/70* (2017.01)

(52) U.S. Cl.
CPC ..... *A47B 88/70* (2017.01)

(58) Field of Classification Search
CPC ..... A47B 88/70; A47B 88/50
See application file for complete search history.

(56) References Cited

U.S. PATENT DOCUMENTS

| | | | | |
|---|---|---|---|---|
| 4,947,661 | A * | 8/1990 | Yoshida | B60R 11/0205 292/226 |
| 9,629,459 | B2 * | 4/2017 | Chen | A47B 88/427 |
| 10,098,459 | B2 * | 10/2018 | Chen | A47B 96/067 |
| 10,342,341 | B2 * | 7/2019 | Chen | A47B 88/57 |
| 10,362,870 | B1 * | 7/2019 | Smith | A47B 88/407 |
| 10,398,228 | B2 * | 9/2019 | Chen | A47B 88/473 |
| 11,357,326 | B1 * | 6/2022 | Hanley | E05B 65/46 |
| 11,540,630 | B2 * | 1/2023 | Chen | A47B 88/423 |
| 11,641,939 | B2 | 5/2023 | Chen et al. | |
| 12,440,025 | B2 * | 10/2025 | Chen | H05K 7/1489 |

(Continued)

FOREIGN PATENT DOCUMENTS

| | | | | |
|---|---|---|---|---|
| EP | 4018883 A1 | 6/2022 | | |
| EP | 4090142 A1 * | 11/2022 | | A47B 88/43 |

(Continued)

*Primary Examiner* — Hanh V Tran
(74) *Attorney, Agent, or Firm* — Best & Flanagan LLP

(57) ABSTRACT

A slide rail mechanism includes a first rail, a movable rail, a locking member and a predetermined component. The movable rail is movable relative to the first rail. When the locking member is in a locking state, the locking member is configured to be blocked by a blocking feature on the first rail. When the locking member is in an unlocking state, the locking member is not blocked by the blocking feature for allowing the movable rail to be moved away from a predetermined position along a predetermined direction relative to the first rail, and the locking member and the predetermined component are engaged with each other in order to hold the locking member in the unlocking state.

19 Claims, 12 Drawing Sheets

(56) References Cited

U.S. PATENT DOCUMENTS

| | | | | |
|---|---|---|---|---|
| 2022/0228402 | A1* | 7/2022 | Hanley | A47B 88/50 |
| 2025/0009127 | A1 | 1/2025 | Chen et al. | |
| 2025/0176714 | A1* | 6/2025 | Chen | A47B 88/477 |

FOREIGN PATENT DOCUMENTS

| | | | |
|---|---|---|---|
| EP | 4489537 | A1 | 1/2025 |
| JP | 2022-99225 | A | 7/2022 |

* cited by examiner

SLIDE RAIL MECHANISM

BACKGROUND OF THE INVENTION

1. Field of the Invention

The present invention relates to a slide rail mechanism, and more particularly, to a slide rail mechanism capable of temporarily holding a locking member in an unlocking state through a predetermined component.

2. Description of the Prior Art

U.S. Pat. No. 11,540,630 B2 discloses a slide rail assembly comprises a first rail, a second rail, a predetermined structure, a locking member and an operating member. The second rail (such as an inner rail) is longitudinally movable relative to the first rail (such as an outer rail). The predetermined structure is arranged on the first rail, and the predetermined structure has a blocking part. The locking member is movably mounted on the second rail. The operating member is configured to drive the locking member to move.

When the second rail is located at a retracted position relative to the first rail, an elastic member abuts against the predetermined structure, such that the locking member is configured to be held in a locking state to be blocked by the blocking part in response to an elastic force of the elastic member, in order to prevent the second rail from being moved away from the retracted position along an opening direction. When a force is applied to the operating member to move the operating member from a first position to a second position, the operating member is configured to drive the locking member to move to switch from the locking state to an unlocking state, such that the locking member is no longer blocked by the blocking part, in order to allow the second rail to be moved away from the retracted position along the opening direction.

Specifically, when the second rail is located at the retracted position relative to the first rail, a user can apply the force to the operating member to move the operating member from the first position to the second position, in order to drive the locking member to switch from the locking state to the unlocking state. However, when the user stop applying the force to the operating member, and when the second rail is still located at the retracted position without being moved along the opening direction by the user, the locking member is configured to return to the locking state from the unlocking state due to the elastic force of the elastic member, such that the second rail is locked at the retracted position by the locking member. In other words, the user must continually apply the force to the operating member to hold the locking member in the unlocking state. Therefore, it is not convenient to the user to operate.

Therefore, for different market requirements, it is important to develop various slide rail products.

SUMMARY OF THE INVENTION

The present invention provides a slide rail mechanism capable of holding a locking member in an unlocking state through a predetermined component.

According to an embodiment of the present invention, a slide rail mechanism comprises a first rail, a movable rail, a locking member, an elastic member and a predetermined component. The first rail comprises a blocking feature. The movable rail is movable relative to the first rail. The locking member is movable relative to the movable rail to be in a locking state or an unlocking state. The predetermined component is arranged on the movable rail. When the movable rail is located at a predetermined position relative to the first rail, the locking member in the locking state is configured to be blocked by the blocking feature, in order to prevent the movable rail from being moved away from the predetermined position along a predetermined direction. When a force is applied to the locking member to move the locking member to switch from the locking state to the unlocking state, the locking member in the unlocking state is no longer blocked by the blocking feature, in order to allow the movable rail to be moved away from the predetermined position along the predetermined direction; when the locking member is in the unlocking state, the locking member and the predetermined component are configured to be engaged with each other in order to hold the locking member in the unlocking state, and the elastic member is configured to accumulate an elastic force. During a process of the movable rail being moved away from the predetermined position along the predetermined direction, the first rail is configured to disengage the locking member from the predetermined component, such that the locking member is moved to switch from the unlocking state to the locking state in response to the elastic force released by the elastic member.

According to another embodiment of the present invention, a slide rail mechanism comprises a first rail, a movable rail, a locking member and a predetermined component. The first rail comprises a blocking feature. The movable rail is movable relative to the first rail. The locking member is movable relative to the movable rail. When the locking member is in a locking state, the locking member is configured to be blocked by the blocking feature, in order to prevent the movable rail from being moved away from a retracted position along a predetermined direction. When the locking member is in an unlocking state, the locking member is not blocked by the blocking feature in order to allow the movable rail to be moved away from the retracted position along the predetermined direction, and the locking member is configured to be engaged with the predetermined component in order to hold the locking member in the unlocking state.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
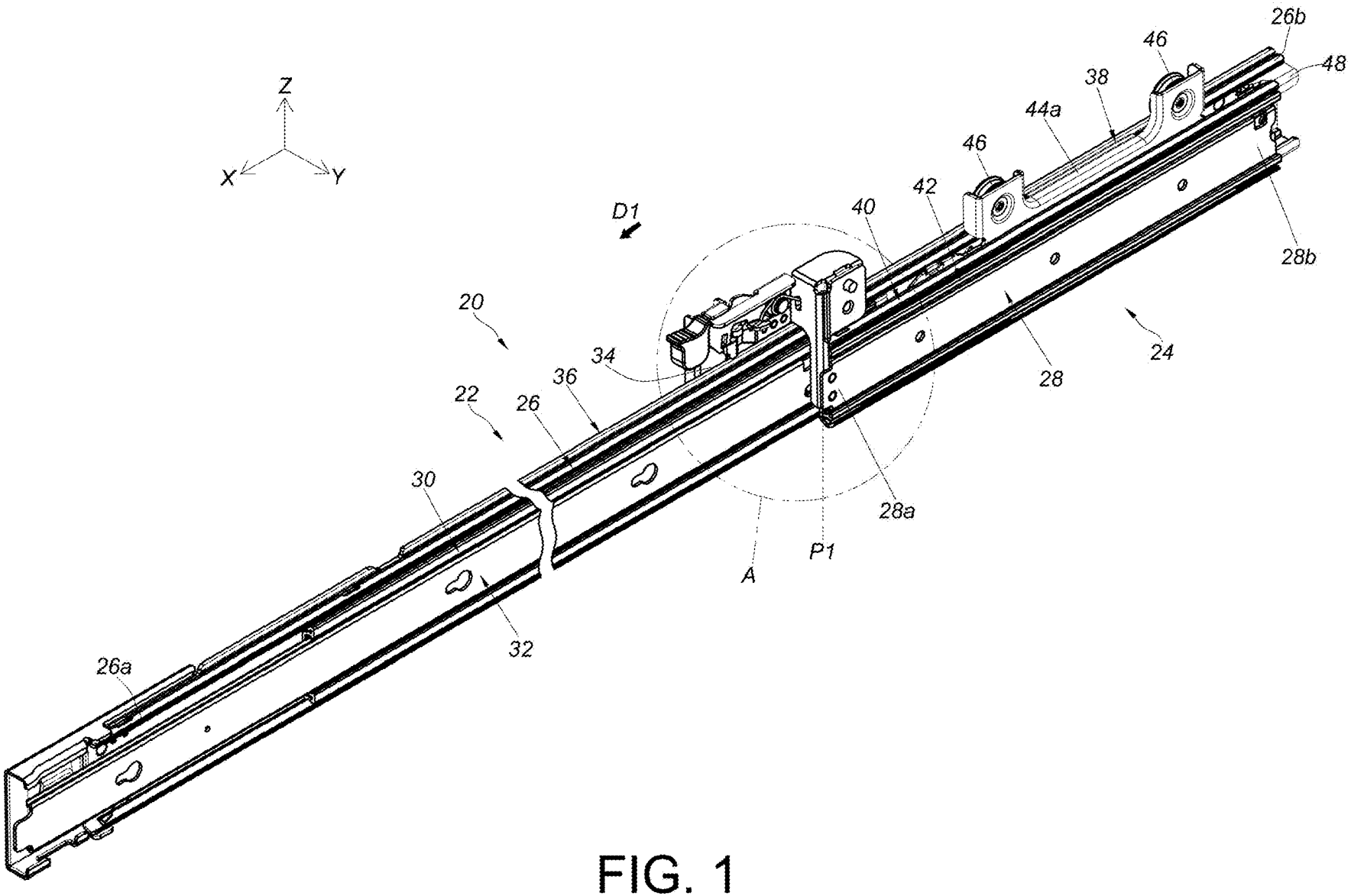
FIG. 1 is a diagram showing a slide rail mechanism in a first viewing angle according to an embodiment of the present invention.
Figure 2:
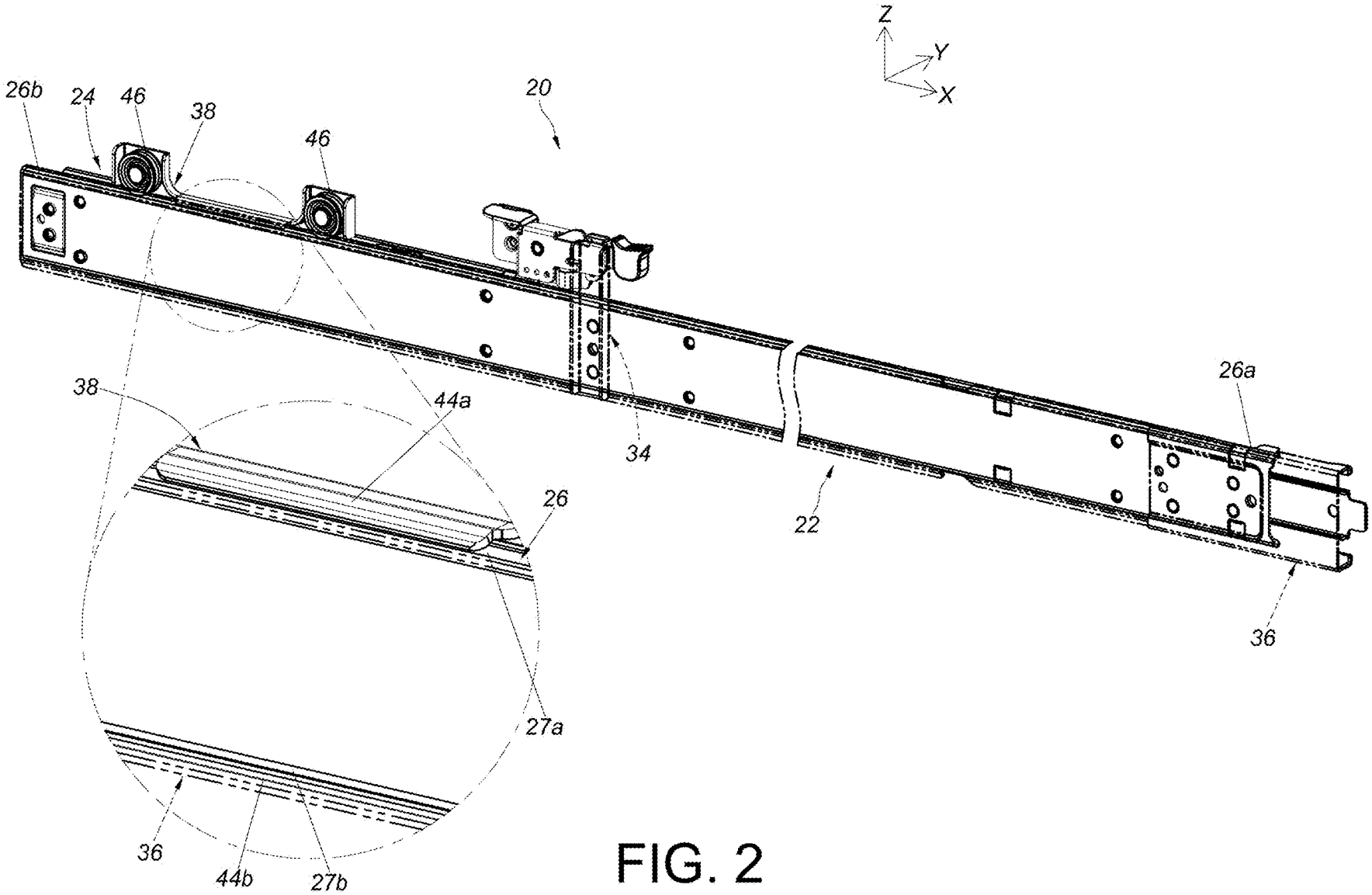
FIG. 2 is a diagram showing the slide rail mechanism in a second viewing angle according to the embodiment of the present invention.
Figure 3:
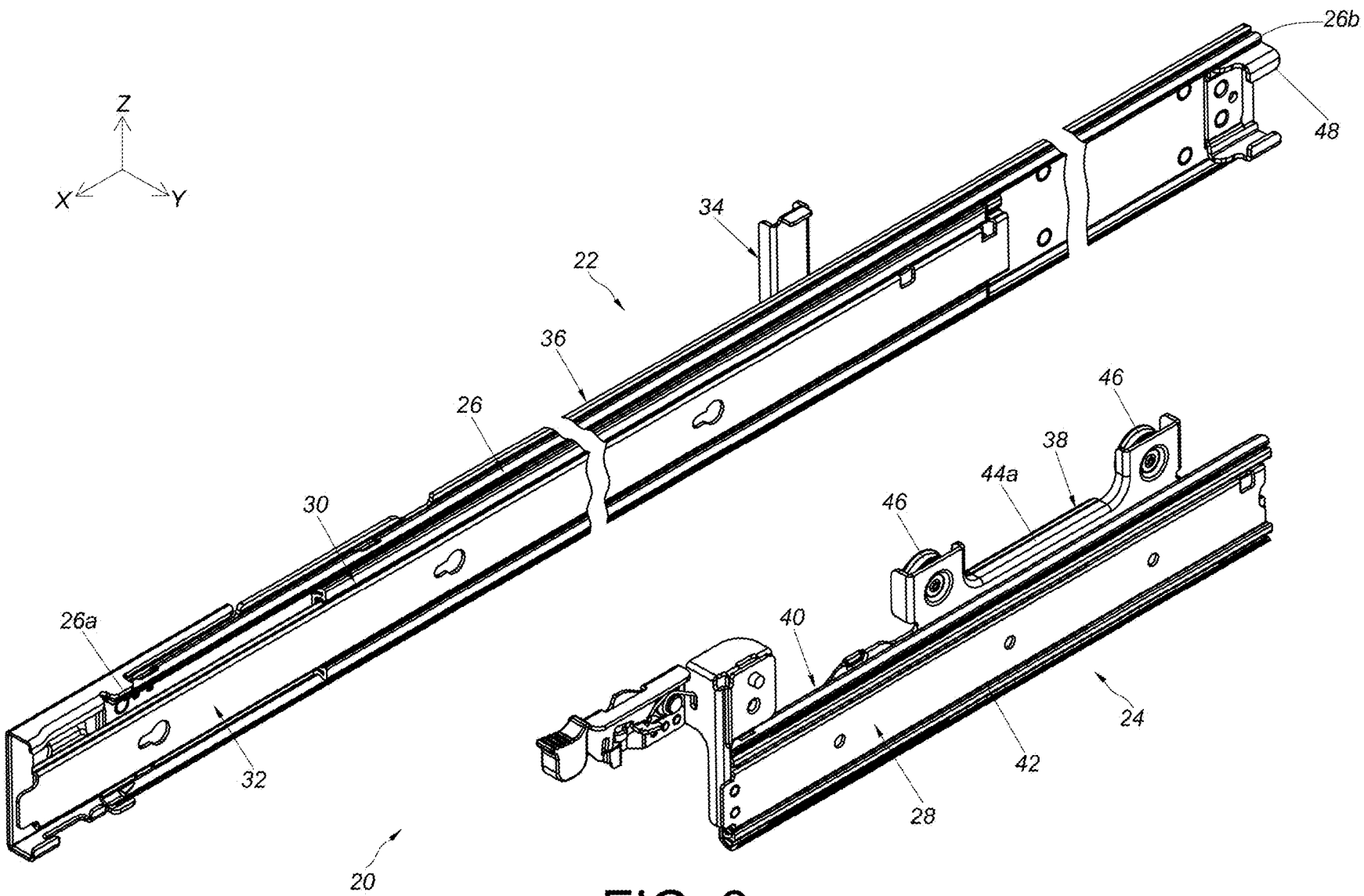
FIG. 3 is an exploded view of the slide rail mechanism according to the embodiment of the present invention.

As shown in FIG. 1 to FIG. 3, a slide rail mechanism 20 comprises a first rail 26 and a movable rail 28 longitudinally movable relative to the first rail 26. In the figures, the X axis is a longitudinal direction (or a length direction or a moving direction of the slide rail), the Y axis is a transverse direction (or a lateral direction of the slide rail), and the Z axis is a vertical direction (or a height direction of the slide rail).

Specifically, the slide rail mechanism 20 comprises a first slide rail assembly 22 and a second slide rail assembly 24. The first slide rail assembly 22 is longer than the second slide rail assembly 24, but the present invention is not limited thereto. The first slide rail assembly 22 comprises the first rail 26, a second rail 30 and a third rail 32. The first rail 26 is arranged with a supporting frame 34. The supporting frame 34 is attached to an auxiliary frame 36 of the first rail 26, and the auxiliary frame 36 is connected (for example, fixedly connected) to the first rail 26, and the supporting frame 34 is connected (for example, fixedly connected) to the auxiliary frame 36, such that the supporting frame 34, the auxiliary frame 36 and the first rail 26 can be regarded as one piece. The second rail 30 is movably mounted between the first rail 26 and the third rail 32.

On the other hand, the second slide rail assembly 24 is movable relative to the first slide rail assembly 22. The second slide rail assembly 24 comprises a supporting rail member 38, an outer rail 40, a middle rail 42 and the movable rail 28. The supporting rail member 38 is movably mounted on the first rail 26. The outer rail 40 is connected to the supporting rail member 38. In the present embodiment, the outer rail 40 and the supporting rail member 38 are fixedly connected to each other and can be regarded as one piece. The middle rail 42 is movably mounted between the outer rail 40 and the movable rail 28.

Preferably, the supporting rail member 38 of the second slide rail assembly 24 is configured to partially cover the first rail 26 of the first slide rail assembly 22. The supporting rail member 38 has at least one supporting section, such as a first supporting section 44*a* and a second supporting section 44*b* configured to hold a first wall 27*a* and a second wall 27*b* of the first rail 26 (as shown in FIG. 2).

Preferably, the supporting rail member 38 is arranged with at least one rolling member 46 (such as a roller as shown in FIG. 2), and the rolling member 46 is configured to contact the first rail 26 (the first wall 27*a* of the first rail 26) for rolling along the length direction of the first rail 26, in order to improve smoothness of movement of the supporting rail member 38 (and the outer rail 40) relative to the first rail 26.

Preferably, the first rail 26 has a first end part 26*a* and a second end part 26*b* opposite to each other, such as a front end part and a rear end part. The first rail 26 is arranged with a blocking part 48 adjacent to the second end part 26*b*. The blocking part 48 is configured to block the outer rail 40, such that the second slide rail assembly 24 can be blocked relative to the first slide rail assembly 22 to be in a retracted state (as shown in FIG. 1).

Figure 4:
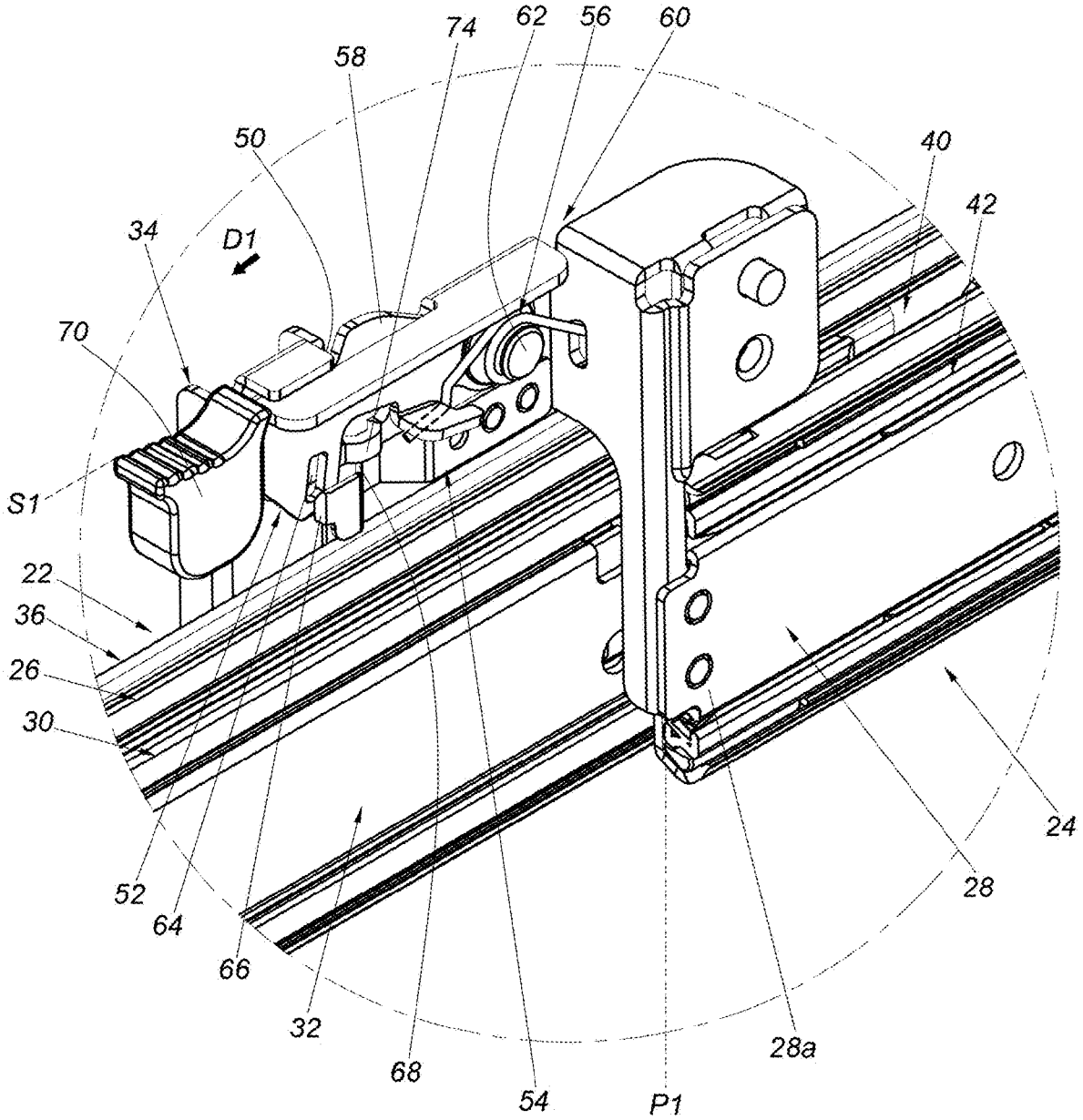
FIG. 4 is an enlarged view of an area A of FIG. 1 for showing a movable rail of the slide rail mechanism being locked at a predetermined position relative to a first rail.

As shown in FIG. 4, the first rail 26 comprises a blocking feature 50. In the present embodiment, the blocking feature 50 is arranged on the supporting frame 34 on the auxiliary frame 36 of the first rail 26, but the present invention is not limited thereto.

The slide rail mechanism 20 further comprises a locking member 52 and a predetermined component 54. Preferably, the slide rail mechanism 20 further comprises an elastic member 56.

The locking member 52 is movable relative to the movable rail 28. When the movable rail 28 is located at a predetermined position P1 relative to the first rail 26, the locking member 52 in a locking state S1 relative to the movable rail 28 is configured to be blocked by the blocking feature 50, in order to be locked relative to the first rail 26. For example, a locking part 58 of the locking member 52 in the locked state S1 is configured to be blocked by the blocking feature 50 in order to prevent the movable rail 28 from being moved away from the predetermined position P1 (please refer to FIG. 1) along a predetermined direction D1 (such as an opening direction) relative to the first rail 26. In the present embodiment, the predetermined position P1 is a retracted position, but the present invention is not limited thereto.

Preferably, the movable rail 28 has a first end part 28*a* and a second end part 28*b* opposite to each other, such as a front end part and a rear end part. The movable rail 28 is arranged with an auxiliary member 60. For example, the auxiliary member 60 is connected (for example, fixedly connected) to the movable rail 28, such that the auxiliary member 60 and the movable rail 28 can be regarded as one piece. The auxiliary member 60 is adjacent to the first end part 28*a* of the movable rail 28.

Preferably, the locking member 52 is movably mounted on the auxiliary member 60. For example, the locking member 52 is pivotally connected to the auxiliary member 60 through a shaft 62, and the locking member 52 is configured to be held in the locking state S1 in response to an elastic force provided by the elastic member 56.

Preferably, the predetermined component 54 is arranged on the auxiliary member 60. In the present embodiment, the predetermined component 54 is an elastic piece, but the present invention is not limited thereto. The locking member 52 has a first engaging feature 64, and the predetermined component 54 has a second engaging feature 66 configured to interact with the first engaging feature 64. The first engaging feature 64 and the second engaging feature 66 can be a combination of a hole and a protrusion, or a combination of a recessed structure and a protruded structure, but the present invention is not limited thereto.

Preferably, the predetermined component 54 is arranged with a guiding structure 68, and the guiding structure 68 has an inclined surface or an arc surface, but the present invention is not limited thereto.

Figure 5:
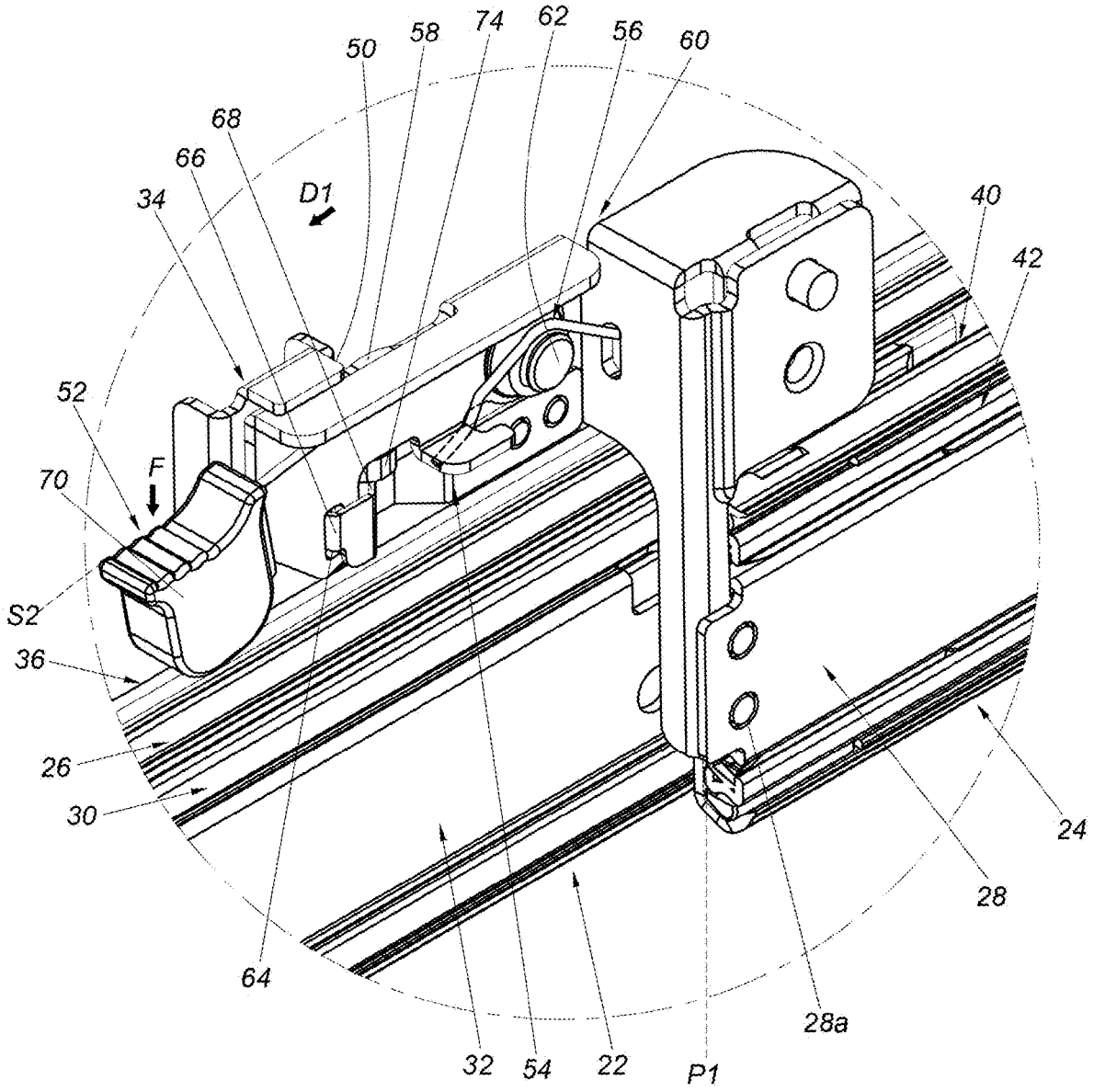
FIG. 5 is a diagram showing the movable rail located at the predetermined position being unlocked relative to the first rail according to the embodiment of the present invention.
Figure 6:
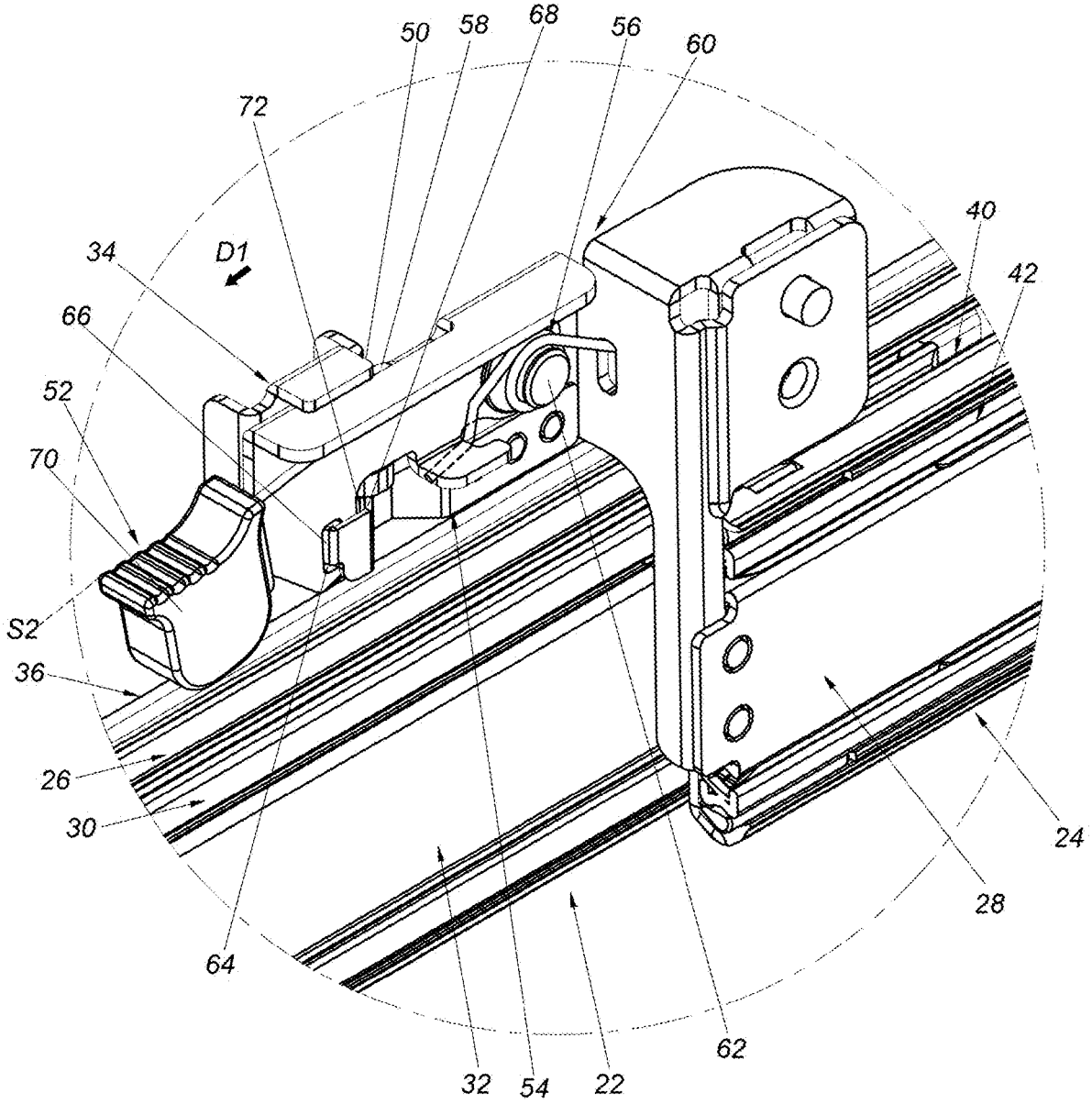
FIG. 6 is a diagram showing the movable rail being moved along a predetermined direction relative to the first rail in a first viewing angle according to the embodiment of the present invention.

As shown in FIG. 5, when a force F is applied to the locking member 52 by a user to move the locking member 52 to switch from the locking state S1 to an unlocking state S2, the locking member 52 in the unlocking state S2 is no longer blocked by the blocking feature 50, in order to be unlocked relative to the first rail 26. For example, the locking part 58 of the locking member 52 in the unlocking state S2 is not blocked by the blocking feature 50 in order to allow the movable rail 28 to be moved away from the predetermined position P1 along the predetermined direction D1 relative to the first rail 26. When the locking member 52 is in the unlocking state S2, the locking member 52 and the predetermined component 54 are configured to be engaged with each other through the first engaging feature 64 and the second engaging feature 66, in order to temporarily hold the locking member 52 in the unlocking state S2. In addition, when the locking member 52 is in the unlocking state S2, the elastic member 56 is in a state of accumulating an elastic force.

Moreover, when the locking member 52 is held in the unlocking state S2, the user can stop applying the force F. In other words, the user does not need to continually apply the force F to the locking member 52. Thus it is convenient to the user to operate.

Preferably, the locking member 52 is arranged with an operating part 70. The user can easily apply the force F to the locking member 52 through the operating part 70, in order to move the locking member 52 to switch from the locking state S1 to the unlocking state S2.

Preferably, synchronization mechanisms (not shown in the figures) are arranged between the outer rail 40 and the middle rail 42 and between the middle rail 42 and the movable rail 28 respectively. When the locking member 52 is in the unlocking state S2 without being blocked by the blocking feature 50, the movable rail 28, the middle rail 42 and the outer rail 40 can be synchronously moved away from the predetermined position P1 along the predetermined direction D1 through the synchronization mechanisms. Moreover, when the movable rail 28, the middle rail 42 and the outer rail 40 are synchronously moved a predetermined distance along the predetermined direction D1, the synchronization mechanisms arranged between the aforementioned rails are configured to be disabled. Such configuration is well known to those skilled in the art, no further illustration is provided for simplification.

Figure 7:
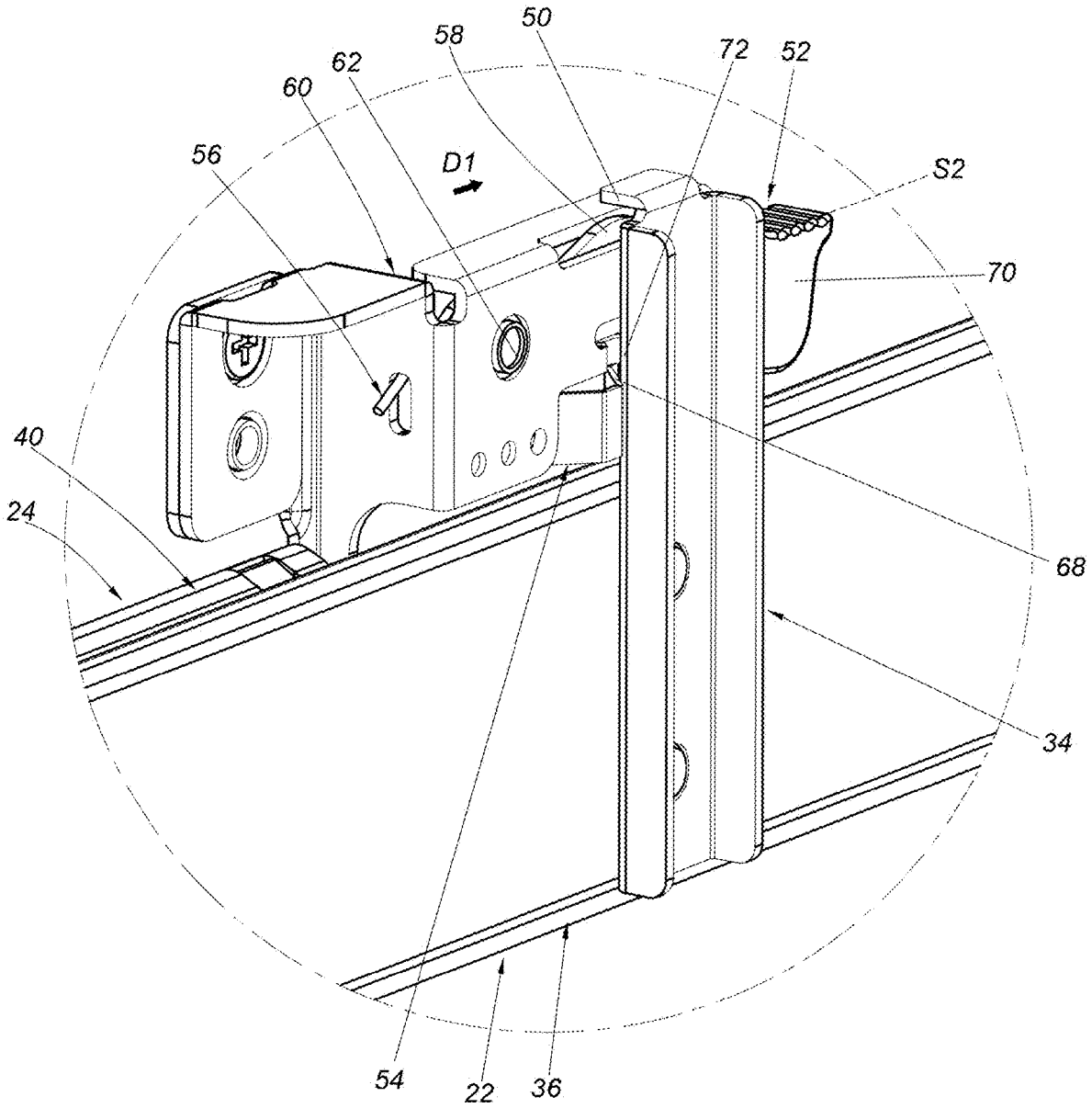
FIG. 7 is a diagram showing the movable rail being moved along the predetermined direction relative to the first rail in a third viewing angle according to the embodiment of the present invention.
Figure 8:
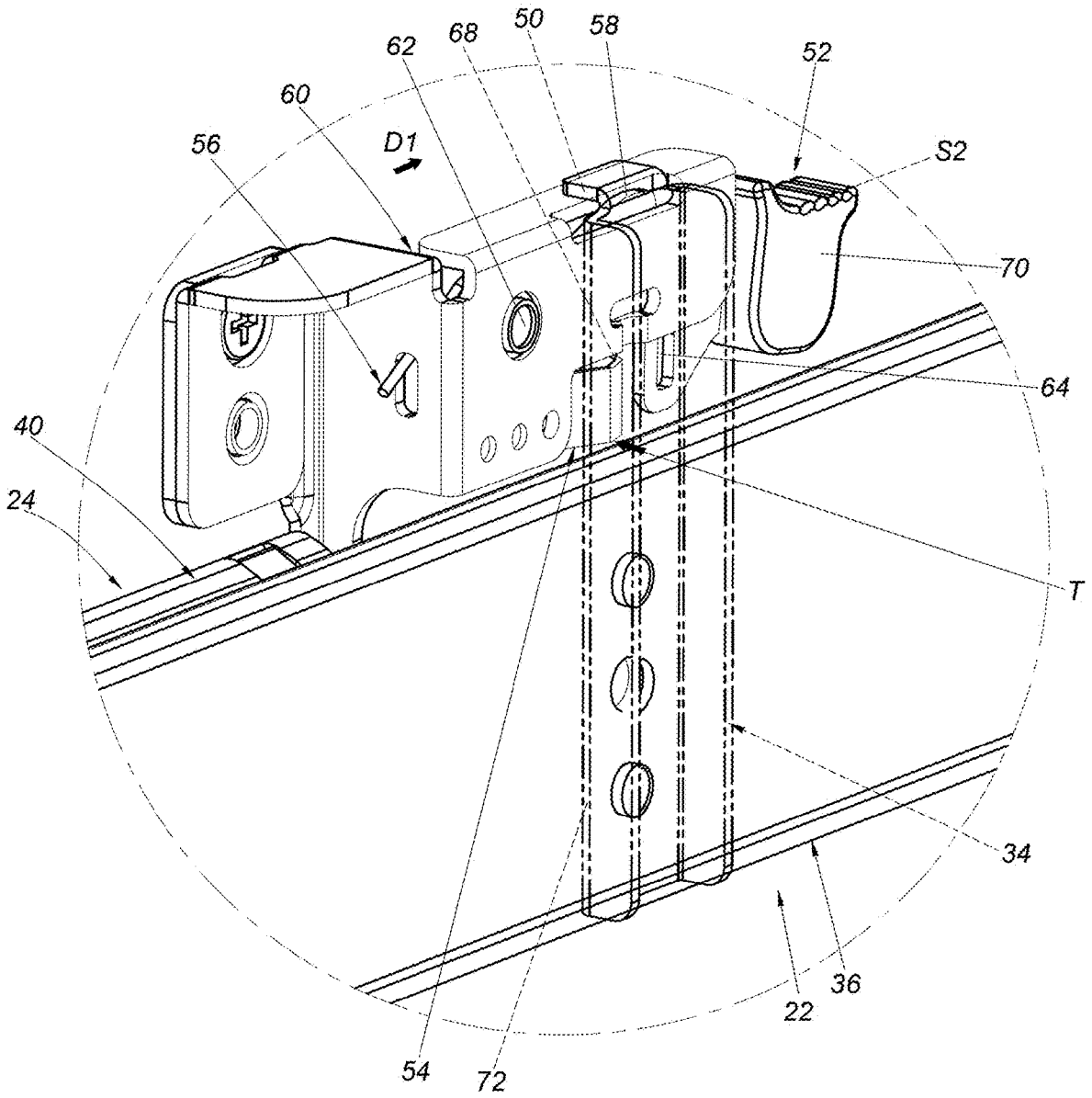
FIG. 8 is a diagram showing the movable rail being further moved along the predetermined direction relative to the first rail in the third viewing angle according to the embodiment of the present invention.
Figure 9:
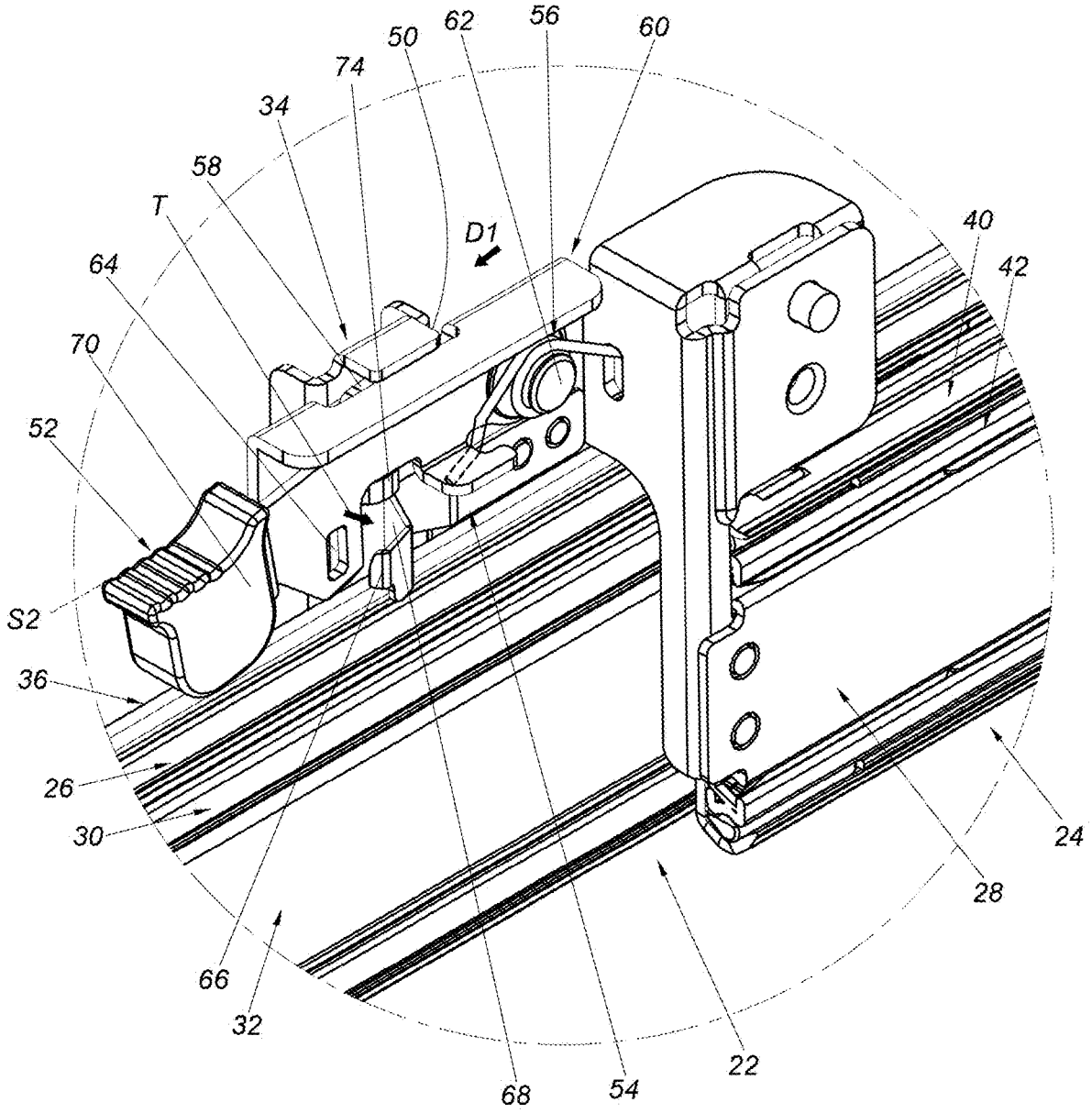
FIG. 9 is a diagram showing the movable rail being further moved along the predetermined direction relative to the first rail in the first viewing angle according to the embodiment of the present invention.
Figure 10:
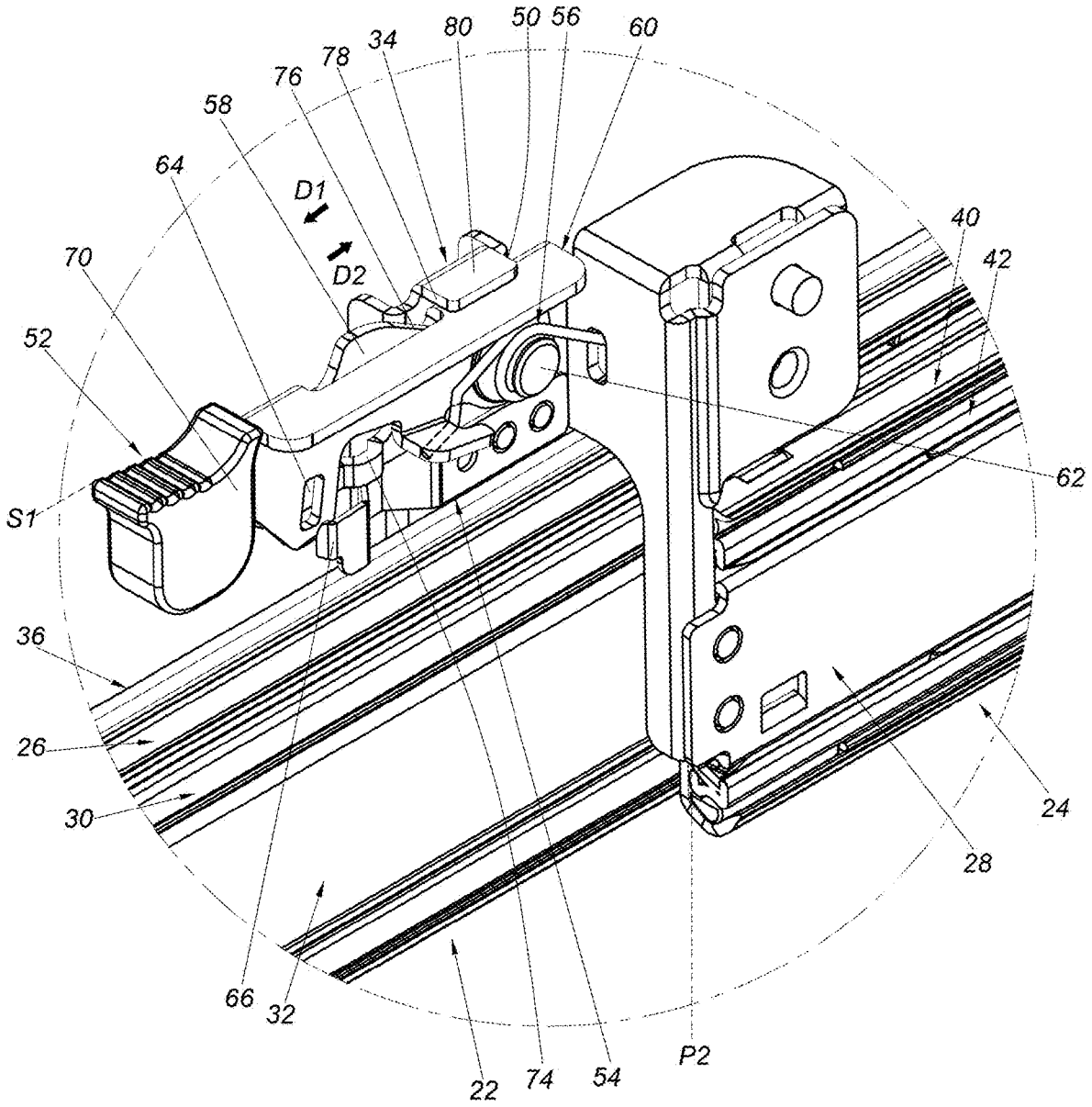
FIG. 10 is a diagram showing the movable rail being continually further moved along the predetermined direction relative to the first rail in the first viewing angle according to the embodiment of the present invention.

As shown in FIG. 6 to FIG. 10, during a process of the movable rail 28 (together with the outer rail 40 and the middle rail 42) being moved from the predetermined position P1 along the predetermined direction D1 to another predetermined position P2 relative to the first rail 26, the first rail 26 is configured to disengage the locking member 52 from the predetermined component 54 (as shown in FIG. 8 and FIG. 9), such that the locking member 52 is configured to return to the locking state S1 (as shown in FIG. 10) from the unlocking state S2 (as shown in FIG. 6 to FIG. 9) in response to the elastic force released by the elastic member 56.

For example, during the process of the movable rail 28 (together with the outer rail 40 and the middle rail 42) being moved from the predetermined position P1 along the predetermined direction D1 relative to the first rail 26, a predetermined part 72 of the supporting frame 34 on the auxiliary frame 36 of the first rail 26 is configured to abut against the guiding structure 68 of the predetermined component 54 (as shown in FIG. 7 and FIG. 8), in order to deflect the predetermined component 54 from an initial state along a transverse direction T (or the lateral direction), in order to disengage the first engaging feature 64 of the locking member 52 from the second engaging feature 66 of the predetermined component 54 (as shown in FIG. 8 and FIG. 9). Such that, the locking member 52 is configured to return to the locking state S1 (as shown in FIG. 10) from the unlocking state S2 (as shown in FIG. 9) in response to the elastic force released by the elastic member 56. In addition, the predetermined component 54 is configured to return to the initial state through its own elasticity.

Therefore, when the movable rail 28 (together with the outer rail 40 and the middle rail 42) is moved relative to the first rail 26 from the predetermined position P1 (as shown in FIG. 5) along the predetermined direction D1 to the predetermined position P2 (as shown in FIG. 10), the first engaging feature 64 of the locking member 52 is disengaged from the second engaging feature 66 of the predetermined component 54, and the locking member 52 is configured to return to the locking state S1 from the unlocking state S2 in response to the elastic force of the elastic member 56.

Preferably, the auxiliary member 60 comprises a limiting part 74 (as shown in FIG. 5 and FIG. 9). When the locking member 52 is moved to switch from the locking state S1 to the unlocking state S2, the limiting part 74 is configured to block the locking member 52 in the unlocking state S2 in order to limit a moving range of the locking member 52. In the present embodiment, the limiting part 74 is a protrusion, but the present invention is not limited thereto.

Preferably, the lock part 58 of the locking member 52 comprises a guiding section 76, and the guiding section 76 has an inclined surface or an arc surface (as shown in FIG. 10). During a process of the movable rail 28 (together with the outer rail 40 and the middle rail 42) being moved from the predetermined position P2 along a predetermined direction D2 (such as a retracting direction) opposite to the predetermined direction D1 to the predetermined position P1 relative to the first rail 26, the guiding section 76 is configured to abut against a corresponding feature 78 of the supporting frame 34, in order to allow the locking part 58 to easily cross the corresponding feature 78, such that the locking 58 is configured to be blocked by the blocking feature 50. In the present embodiment, the corresponding feature 78 and the blocking feature 50 are located at two opposite ends (such as a front end and a rear end) of an extension part 80 of the supporting frame 34, but the present invention is not limited thereto.

Figure 11:
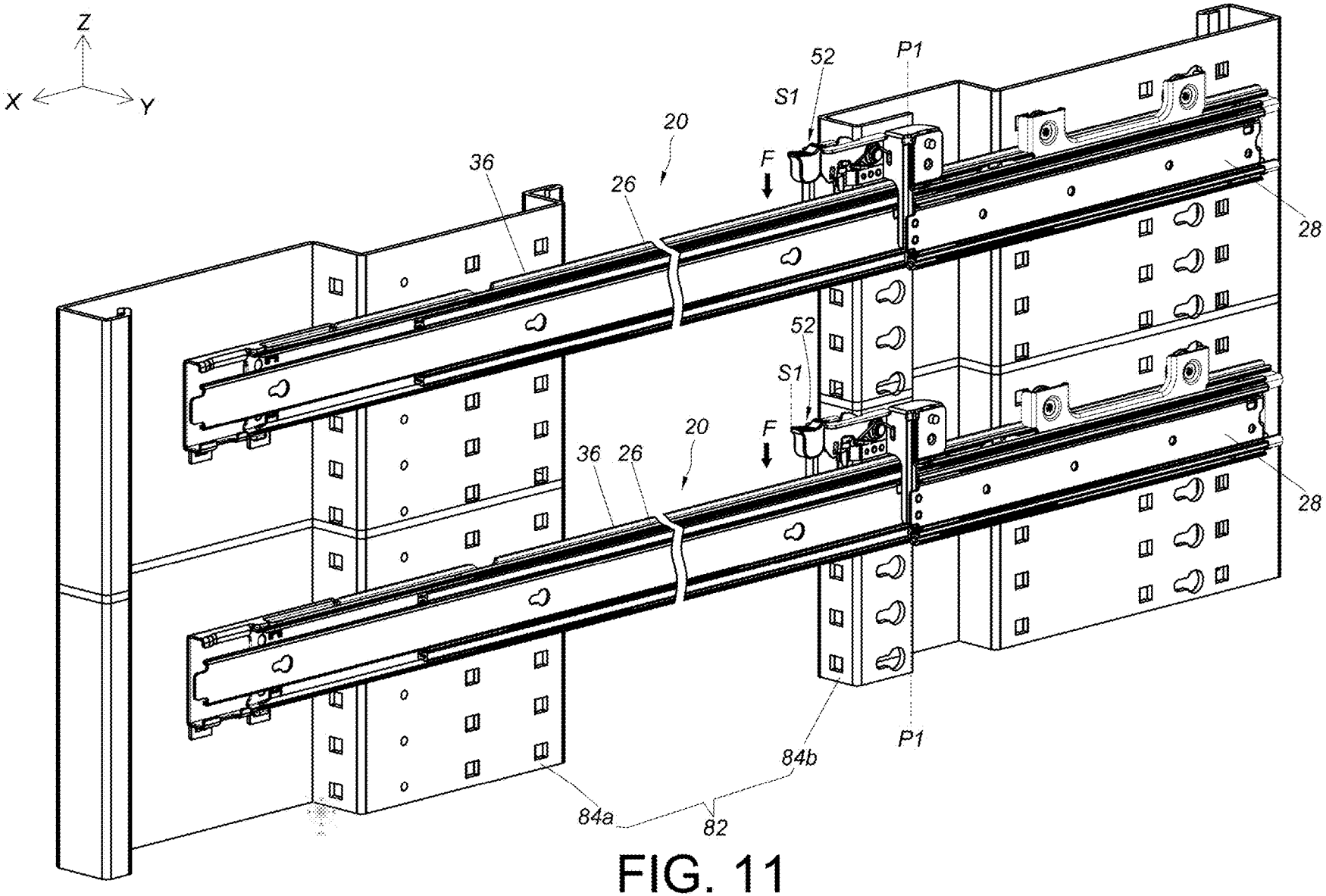
FIG. 11 is a diagram showing a plurality of the slide rail mechanisms being mounted to a rack with the movable rails of the slide rail mechanisms being locked at the predetermined position relative to the first rails according to the embodiment of the present invention.

As shown in FIG. 11, a plurality of slide rail mechanisms 20 (such as two slide rail mechanisms 20) have the same structural configuration (since the structural configuration of the slide rail mechanism 20 have been disclosed, no further illustration is provided for simplification). Furthermore, the slide rail mechanisms 20 are mounted at different heights of a rack 82 through the first rails 26 (the auxiliary frames 36 of the first rails 26). In the present embodiment, the rack 82 has a first post 84*a* and a second post 84*b* (such as a front post and a rear post), but the present invention is not limited thereto. The movable rails 28 of the slide rail mechanisms 20 are configured to carry carried objects (not shown in figures), and the movable rails 28 are locked at the predetermined position P1 relative to the first rails 26 through the locking members 52 in the locking state S1.

Figure 12:
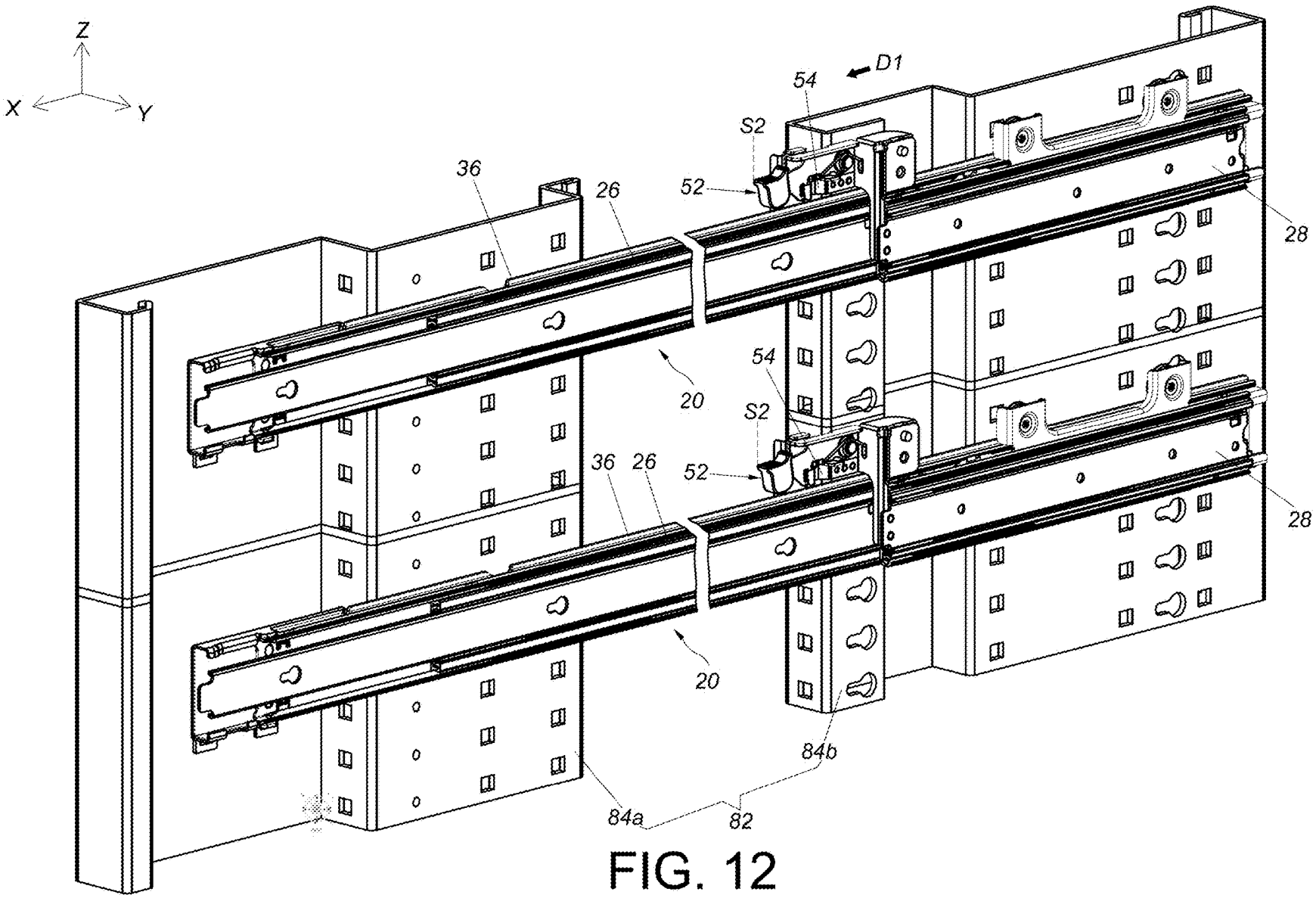
FIG. 12 is a diagram showing the plurality of the slide rail mechanisms being mounted to the rack with the movable rails of the slide rail mechanisms being unlocked at the predetermined position relative to the first rails according to the embodiment of the present invention.

As shown in FIG. 11 and FIG. 12, the user can apply the force F to move the locking member 52 to switch from the locking state S1 (as shown in FIG. 11) to the unlocking state S2 (as shown in FIG. 12), and the predetermined component 54 is configured to temporarily hold the locking member 52 in this unlocking state S2. When the locking member 52 is held in the unlocking state S2, the user can stop applying the force F. In other words, the user does not need to continuously apply the force F to the locking member 52. As such, the user can operate other components. For example, the user can pull out the carried object carried by the movable rail 28 of the slide rail mechanism 20 from the predetermined position P1 along the predetermined direction D1 to be adjacent to the first post 84*a* (such as the front post), in order to facilitate maintenance operation to the slide rail and/or the carried object when the user stands in front of the rack 82. Therefore, through temporarily holding the locking members 52 in the unlocking state S2 by the predetermined components 54 of the slide rail mechanisms 20, it is convenient for the user to operate the slide rail mechanisms 20 alone.

Therefore, the slide rail mechanism 20 according to the embodiment of the present invention has the following technical features:

1. When the movable rail 28 is located at the predetermined position P1 (such as the retracted position, but the present invention is not limited thereto) relative to the first rail 26, the locking member 52 in the locking state S1 is configured to be blocked by the blocking feature 50, in order to prevent the movable rail 28 from being moved away from the predetermined position P1 along the predetermined direction D1. When the force F is applied to the locking member 52 to move the locking member 52 to switch from the locking state S1 to the unlocking state S2, the locking member 52 in the unlocking state S2 is no longer blocked by the blocking feature 50, in order to allow the movable rail 28 to be moved away from the predetermined position P1 along the predetermined direction D1. When the locking member 52 is in the unlocking state S2, the locking member 52 and the predetermined component 54 are engaged with each other to temporarily hold the locking member 52 in the unlocking state S2, such that even if the movable rail 28 is still located at the predetermined position P1, the locking member 52 will not return to the locking state S1 from the unlocking state S2. During the process of the movable rail 28 being moved from the predetermined position P1 along the predetermined direction D1 relative to the first rail 26, the first rail 26 is configured to disengage the locking member 52 from the predetermined component 54, in order to allow the locking member 52 to return to the locking state S1 from the unlocking state S2. Preferably, the locking member 52 is configured to return to the locking state S1 from the unlocking state S2 in response to the elastic force of the elastic member 56.
2. When the locking member 52 is engaged with the predetermined component 54 to be held in the unlocking state S2, the user can stop applying the force F. In other words, the user does not need to continuously apply the force F to the locking member 52. Therefore, it is convenient for the user to operate the slide rail mechanism 20, so as to facilitate maintenance of the slide rail and/or the carried object.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A slide rail mechanism, comprising:

a first rail comprising a blocking feature;

a movable rail movable relative to the first rail;

a locking member movable relative to the movable rail to be in a locking state or an unlocking state;

an elastic member; and a predetermined component arranged on the movable rail;

wherein when the movable rail is located at a predetermined position relative to the first rail, the locking member in the locking state is configured to be blocked by the blocking feature, in order to prevent the movable rail from being moved away from the predetermined position along a predetermined direction;

wherein when a force is applied to the locking member to move the locking member to switch from the locking state to the unlocking state, the locking member in the unlocking state is no longer blocked by the blocking feature, in order to allow the movable rail to be moved away from the predetermined position along the predetermined direction;

wherein when the locking member is in the unlocking state, the locking member and the predetermined component are configured to be engaged with each other in order to hold the locking member in the unlocking state, and the elastic member is configured to accumulate an elastic force;

wherein during a process of the movable rail being moved away from the predetermined position along the predetermined direction, the first rail is configured to disengage the locking member from the predetermined component, such that the locking member is moved to switch from the unlocking state to the locking state in response to the elastic force released by the elastic member.

2. The slide rail mechanism of claim 1, comprising a first slide rail assembly and a second slide rail assembly; wherein the first slide rail assembly comprises the first rail, a second rail and a third rail; wherein the first rail is arranged with a supporting frame, and the second rail is movably mounted between the first rail and the third rail; wherein the second slide rail assembly is movable relative to the first slide rail assembly, the second slide rail assembly comprises a supporting rail member, an outer rail, a middle rail and the movable rail; wherein the supporting rail member is movably mounted on the first rail, the outer rail is connected to the supporting rail member, and the middle rail is movably mounted between the outer rail and the movable rail.

3. The slide rail mechanism of claim 2, wherein the supporting rail member of the second slide rail assembly is configured to partially cover the first rail of the first slide rail assembly.

4. The slide rail mechanism of claim 2, wherein the supporting frame of the first rail comprises the blocking feature.

5. The slide rail mechanism of claim 2, wherein during the process of the movable rail being moved away from the predetermined position along the predetermined direction, a predetermined part of the supporting frame of the first rail is configured to disengage the locking member from the predetermined component.

6. The slide rail mechanism of claim 5, wherein the movable rail is arranged with an auxiliary member, the locking member is movably mounted on the auxiliary member, and the predetermined component is arranged on the auxiliary member on the movable rail; wherein the locking member has a first engaging feature and the predetermined component has a second engaging feature; wherein when the locking member is in the unlocking state, the locking member and the predetermined component are configured to be engaged with each other through the first engaging feature and the second engaging feature in order to hold the locking member in the unlocking state.

7. The slide rail mechanism of claim 6, wherein the locking member is pivotally connected to the auxiliary member through a shaft.

8. The slide rail mechanism of claim 6, wherein the predetermined component is an elastic piece and arranged with a guiding structure; wherein during the process of the movable rail being moved away from the predetermined position along the predetermined direction, the supporting frame of the first rail is configured to abut against the guiding structure of the predetermined component to deflect the predetermined component, in order to disengage the locking member from the predetermined component.

9. The slide rail mechanism of claim 6, wherein the locking member is arranged with an operating part to allow a user to apply the force to the locking member through the operating part to move the locking member to switch from the locking state to the unlocking state.

10. The slide rail mechanism of claim 9, wherein the auxiliary member comprises a limiting part; wherein when the locking member is moved to switch from the locking state to the unlocking state, the limiting part is configured to block the locking member in the unlocking state.

11. A slide rail mechanism, comprising:

a first rail comprising a blocking feature;

a movable rail movable relative to the first rail;

a locking member movable relative to the movable rail; and a predetermined component;

wherein when the locking member is in a locking state, the locking member is configured to be blocked by the blocking feature, in order to prevent the movable rail from being moved away from a retracted position along a predetermined direction;

wherein when the locking member is in an unlocking state, the locking member is not blocked by the blocking feature in order to allow the movable rail to be moved away from the retracted position along the predetermined direction, and the locking member is configured to be engaged with the predetermined component in order to hold the locking member in the unlocking state;

wherein during a process of the movable rail being moved away from the retracted position along the predetermined direction, the locking member and the predetermined component are configured to be disengaged from each other, and the locking member is configured to be moved to switch from the unlocking state to the locking state in response to an elastic force.

12. The slide rail mechanism of claim 11, comprising a first slide rail assembly and a second slide rail assembly; wherein the first slide rail assembly comprises the first rail, a second rail and a third rail; wherein the first rail is arranged with a supporting frame, and the second rail is movably mounted between the first rail and the third rail; wherein the second slide rail assembly is movable relative to the first slide rail assembly, the second slide rail assembly comprises a supporting rail member, an outer rail, a middle rail and the movable rail; wherein the supporting rail member is movably mounted on the first rail, the outer rail is connected to the supporting rail member, and the middle rail is movably mounted between the outer rail and the movable rail.

13. The slide rail mechanism of claim 12, wherein the supporting rail member of the second slide rail assembly is configured to partially cover the first rail of the first slide rail assembly.

14. The slide rail mechanism of claim 12, wherein during the process of the movable rail being moved away from the retracted position along the predetermined direction, a predetermined part of the supporting frame of the first rail is configured to disengage the locking member from the predetermined component.

15. The slide rail mechanism of claim 14, wherein the movable rail is arranged with an auxiliary member, the locking member is movably mounted on the auxiliary member, and the predetermined component is arranged on the auxiliary member; wherein the locking member has a first engaging feature and the predetermined component has a second engaging feature; wherein when the locking member is in the unlocking state, the locking member and the predetermined component are configured to be engaged with each other through the first engaging feature and the second engaging feature in order to hold the locking member in the unlocking state.

16. The slide rail mechanism of claim 15, wherein the locking member is pivotally connected to the auxiliary member through a shaft.

17. The slide rail mechanism of claim 15, wherein the predetermined component is an elastic piece and arranged with a guiding structure; wherein during the process of the movable rail being moved away from the retracted position along the predetermined direction, the supporting frame of the first rail is configured to abut against the guiding structure of the predetermined component to deflect the predetermined component, in order to disengage the locking member from the predetermined component.

18. The slide rail mechanism of claim 15, wherein the locking member is arranged with an operating part to allow a user to apply a force to the locking member through the operating part to move the locking member to switch from the locking state to the unlocking state.

19. The slide rail mechanism of claim 18, wherein the auxiliary member comprises a limiting part; wherein when the locking member is moved to switch from the locking state to the unlocking state, the limiting part is configured to block the locking member in the unlocking state.

* * * * *